US008419499B2

(12) United States Patent
Chang

(10) Patent No.: US 8,419,499 B2
(45) Date of Patent: Apr. 16, 2013

(54) EYEBALL OF TOY

(75) Inventor: Jen-Tsorng Chang, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 934 days.

(21) Appl. No.: 12/475,514

(22) Filed: May 30, 2009

(65) Prior Publication Data

US 2010/0015885 A1 Jan. 21, 2010

(30) Foreign Application Priority Data

Jul. 18, 2008 (CN) ..... 2008 1 0302807

(51) Int. Cl.
*A63H 3/38* (2006.01)

(52) U.S. Cl.
USPC ..... 446/392; 446/484; 446/389; 446/219; 365/154; 359/296

(58) Field of Classification Search ..... 446/392, 446/389, 484–485, 219; *A63H 3/36, 3/38*
See application file for complete search history.

(56) References Cited

U.S. PATENT DOCUMENTS

| | | | | |
|---|---|---|---|---|
| 5,894,367 | A * | 4/1999 | Sheridon | 359/623 |
| 5,900,923 | A * | 5/1999 | Prendergast et al. | 351/221 |
| 2006/0007523 | A1 * | 1/2006 | Tam | 359/296 |
| 2006/0007524 | A1 * | 1/2006 | Tam | 359/296 |
| 2006/0007525 | A1 * | 1/2006 | Tam et al. | 359/296 |
| 2006/0039181 | A1 * | 2/2006 | Yang et al. | 365/154 |

FOREIGN PATENT DOCUMENTS

| | | | |
|---|---|---|---|
| GB | 2057277 | * | 4/1981 |
| WO | WO 2006051419 | * | 5/2006 |

* cited by examiner

*Primary Examiner* — Gene Kim
*Assistant Examiner* — Matthew B Stanczak
(74) *Attorney, Agent, or Firm* — Altis Law Group, Inc.

(57) ABSTRACT

An exemplary eyeball of toy includes a transparent chamber, a plurality of electrified balls rotatably received in the chamber and a plurality of annular film electrodes concentrically arranged on the chamber. Each of the electrified balls has a first hemisphere and a second hemisphere. The first hemisphere and the second hemisphere are in different colors. The first hemisphere and the second hemisphere carry opposite electrical charges. The annular film electrodes are substantially arranged on a common plane and face the electrified balls.

18 Claims, 5 Drawing Sheets

EYEBALL OF TOY

BACKGROUND

1. Technical Field

The present invention relates to fittings of a toy, and particularly to an eyeball of a toy.

2. Description of Related Art

With the improvement of production technology, the simulation degree of toys becomes higher and higher. For example, it is highly desired for dolls to have rotatable eyeballs and blinking eyes.

Because pupil of an eye accounts for a large proportion of an eyeball, the changing of pupil can reflect the changing of emotion. For example, when a person is scared, nervous, or happy, the eye of the person will dilate. However, a typical eyeball of a toy usually is made by printing ink or dye painting or chromatic plastic paster, such that the pupil can not change its size. It looks stiff and can not express abundant emotions.

Therefore, a new eyeball of a toy is desired to overcome the shortcomings described above.

BRIEF DESCRIPTION OF THE DRAWINGS

Many aspects of the present eyeball of a toy can be better understood with reference to the following drawings. The components in the drawings are not necessarily to scale, the emphasis instead being placed upon clearly illustrating the principles of the present eyeball of a toy. Moreover, in the drawings, like reference numerals designate corresponding parts throughout the several views.

DETAILED DESCRIPTION

Reference will now be made to the drawings to describe in detail exemplary embodiments of the eyeball of a toy.

Figure 1:
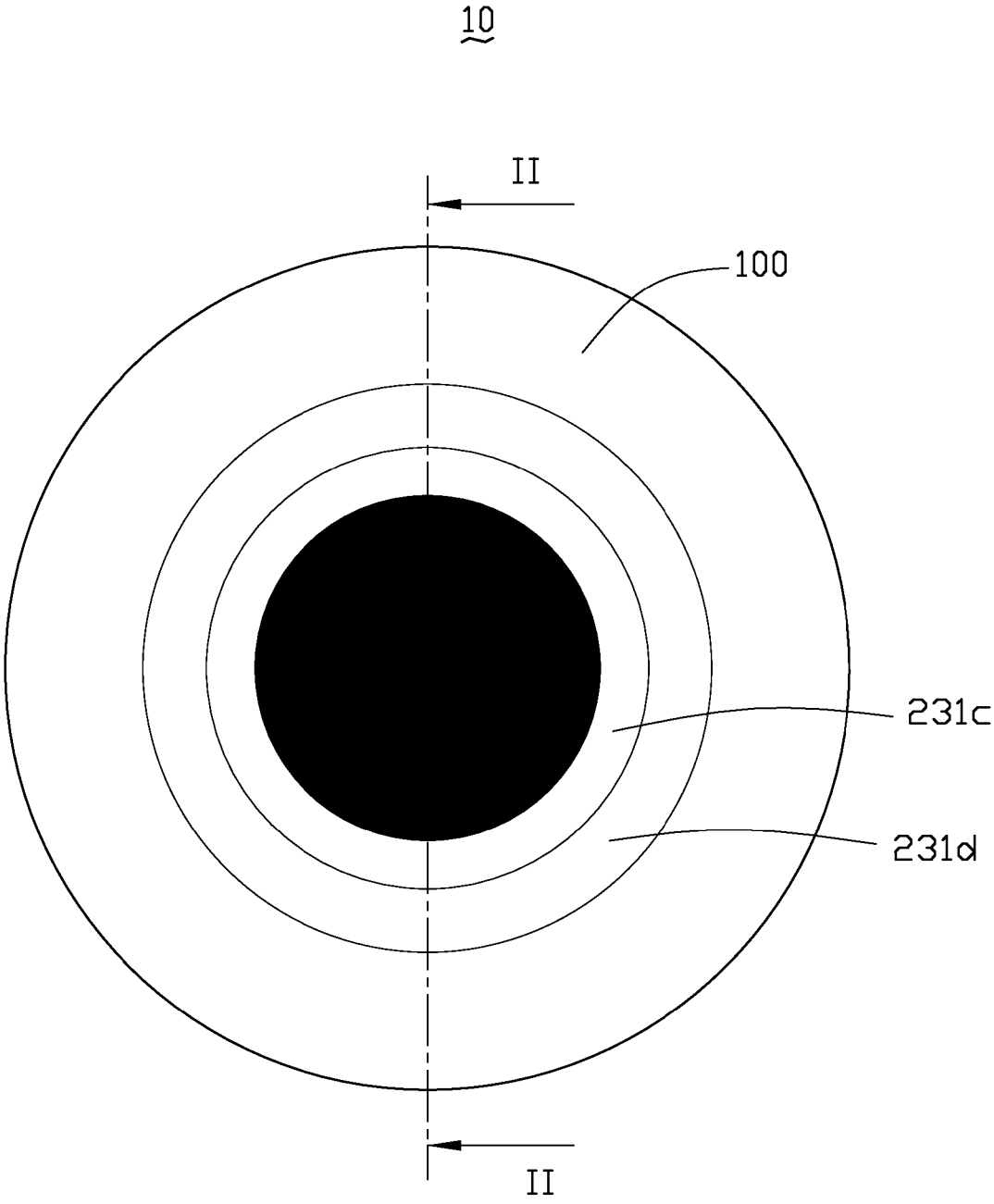
FIG. 1 is a schematic plan view of an eyeball of a toy according to a first embodiment.
Figure 2:
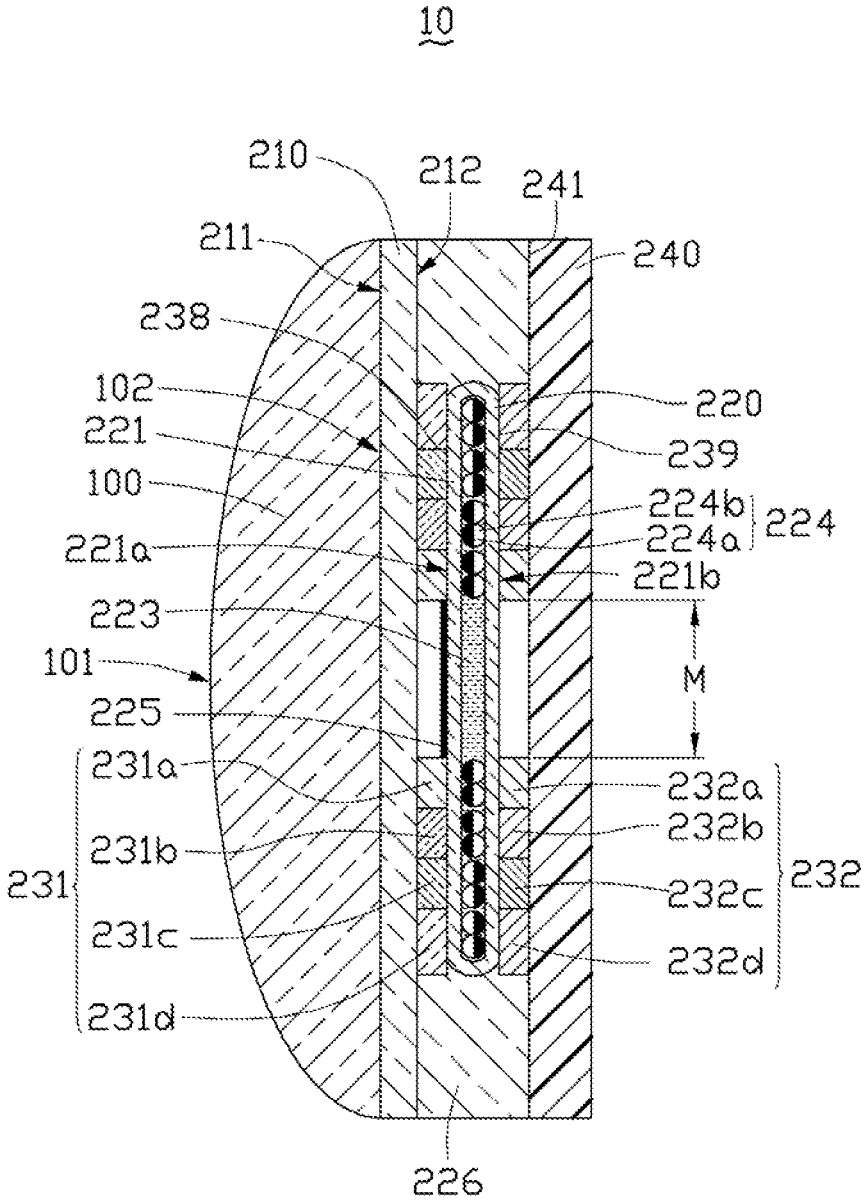
FIG. 2 is a schematic, cross-sectional view of the eyeball in FIG. 1, taken along the II-II line.

Referring to FIGS. 1 and 2, an eyeball 10 of a toy (not shown), in accordance with a first embodiment, includes a transparent substrate 210, a discoloration layer 220, a first group of annular film electrodes 231, a second group of annular film electrodes 232 and a supporting substrate 240.

The transparent substrate 210 includes a first surface 211 and an opposite second surface 212. The transparent substrate 210 can be made of plastic or glass. In the present embodiment, the transparent substrate 210 is made of glass. The shape of the transparent substrate 210 can be disc or bowl-shaped. For easy making, the transparent substrate 210 is in a disc shape.

The supporting substrate 240 includes a third surface 241. The supporting substrate 240 can be made of plastic or glass. In the present embodiment, the supporting substrate 240 is made of white plastic. The shape of the supporting substrate 240 can be disc or bowl-shaped. For easy making, the supporting substrate 240 is in a disc shape.

The discoloration layer 220 is carried out by electrochromic method which is capable of changing colors under an electronic field. The electrochromic method can be selected from rotating imaging, microencapsulated electrophoresis, cholesteric liquid crystal, electrowetting or electrochromic glass, and so on.

In the present embodiment, the discoloration layer 220 adopts an electrophoresis method. The discoloration layer 220 includes a transparent chamber 221. The chamber 221 is arranged between the two groups of annular film electrodes 231, 232, and the chamber 221 includes a first peripheral surface 221*a* and a second peripheral surface 221*b* at opposite sides thereof. The chamber 221 defines a central region M on the first peripheral surface 221*a*. A coating 225 is formed on the first peripheral surface 221*a* at the central region M. The coating 225 faces towards the transparent substrate 210. A dimension of the coating 225 is substantially the same as that of the central region M. In the present embodiment, the coating 225 is in black color. An oily liquid 223 is filled in the chamber 21. A number of electrified balls 224 are distributed in the oily liquid 223. Each electrified ball 224 has a first hemisphere 224*a* and a second hemisphere 224*b*. The first hemisphere 224*a* and the second hemisphere 224*b* are in different colors, respectively. In the present embodiment, the first hemisphere 224*a* is black , and the second hemisphere 224*b* is white. In an alternative embodiment, the first and the second hemispheres 224*a*, 224*b* can he other colors. The first hemisphere 224*a* and the second hemisphere 224*b* carry opposite electrical charges. In the present the first hemisphere 224*a* is electropositive, and the second hemisphere 224*b* is electronegative. The electrified balls 224 can be made of polyethylene.

The first group of annular film electrodes 231 and the second group of annular film electrodes 232 each have a dielectric layer 239 covered thereon. Alternatively, the chamber 221 can be made of dielectric material, thus the dielectric layer 239 can be omitted. The first group of annular film electrodes 231 is made of transparent material which can he selected from indium tin oxide transparent electrode film or zinc oxide transparent electrode film. In the present embodiment, the first group of annular film electrodes 231 is made of indium tin oxide transparent electrode film. The first group of annular film electrodes 231 is attached to the first peripheral surface 221*a*, and is sandwiched between the chamber 221 and the transparent substrate 210. The first group of annular film electrodes 231 includes four annular film electrodes arranged from center to periphery which are the first annular film electrode 231*a*, the second annular film electrode 231*b*, the third annular film electrode 231*c* and the fourth annular film electrode 231*d*. Each of the annular film electrodes 231*a*, 231*b*, 231*c*, 231*d* has a through hole defined in a center thereof. The through holes are of different diameters. A dimension of the through hole of the annular film electrode 231*a* is substantially the same as that of the coating 225 and the central region M. The annular film electrodes 231*a*, 231*b*, 231*c*, 231*d* are concentrically arranged. A dielectric coating 238 is sandwiched between two adjacent of the annular film electrodes 231*a*, 231*b*, 231*c*, 231*d*. It is understood that, to make the changing effect more apparent, the first group of annular film electrodes 231 can include more than tour annular film electrodes.

The second group of annular film electrodes 232 is made of opaque metallic material, such as gold, aluminum or chromium and so on. In the present embodiment , the second group of annular film electrodes 232 is made of aluminum material. The second group of annular film electrodes 232 is attached to the second peripheral surface 221*b*, and is sandwiched between the chamber 221 and the supporting substrate 240. The second group of annular film electrodes 232 includes four annular film electrodes arranged from center to periphery which are the fifth annular film electrode 232*a*, the sixth annular film electrode 232*b*, the seventh annular film electrode 232*c* and the eighth annular film electrode 232*d*. It should be understood that, to make the change effect more apparent, the second group of annular film electrodes 232 can include more than four annular film electrodes. The first, the second, the third, and the fourth annular film electrodes 231*a*, 231*b*, 231*c*, 231*d* respectively correspond to the fifth, the sixth, the seventh, and the eighth annular film electrodes 232*a*, 232*b*, 232*c*, 232*d*.

The eyeball 10 can only include the second group of annular film electrodes 232, wherein the second group of annular film electrodes 232 is attached to the third surface 241 of the supporting substrate 240. Alternatively, the eyeball 10 can only include the first group of annular film, electrodes 231, wherein the first group of annular film electrodes 231 is attached to the second surface 212 of the transparent substrate 210. For better changing effect and faster changing speed, in the present embodiment, the eyeball 10 includes the two groups of annular film electrodes 211, 212.

The periphery of the transparent substrate 210 and the supporting substrate 240 can be sealed by a transparent material 226, or the space between the transparent substrate 210 and the supporting substrate 240 besides the discoloration layer 220 can be filled by the transparent material 226. In the present embodiment, the transparent material 226 is glass.

The eyeball 10 can further include a spherical lens 100 arranged on the first surface 211 of the transparent substrate 210. Otherwise, the spherical lens 100 can be positioned directly on the first group of annular film electrodes 231 if the transparent substrate 210 is omitted. The spherical lens 100 includes a spherical surface 101 and an opposite interface 102. The interface 102 can be a plane or a concave surface. In the present embodiment, the interface 102 is a flat surface. The spherical lens 100 can be made of plastic or glass. Here, the spherical lens 100 is made of glass.

Figure 3:
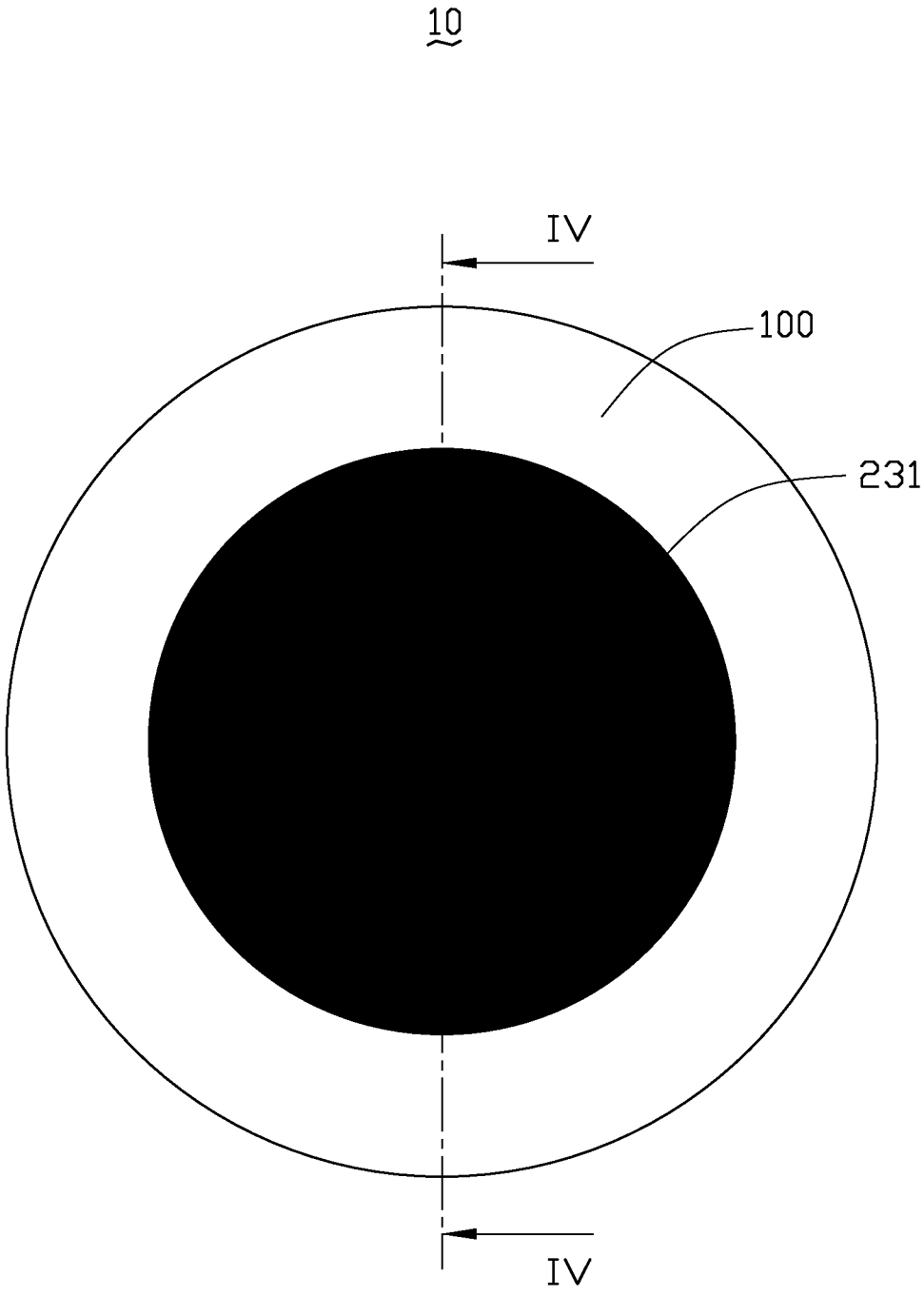
FIG. 3 is a schematic plan view of the eyeball in FIG. 1 when the pupil of the eyeball expands.
Figure 4:
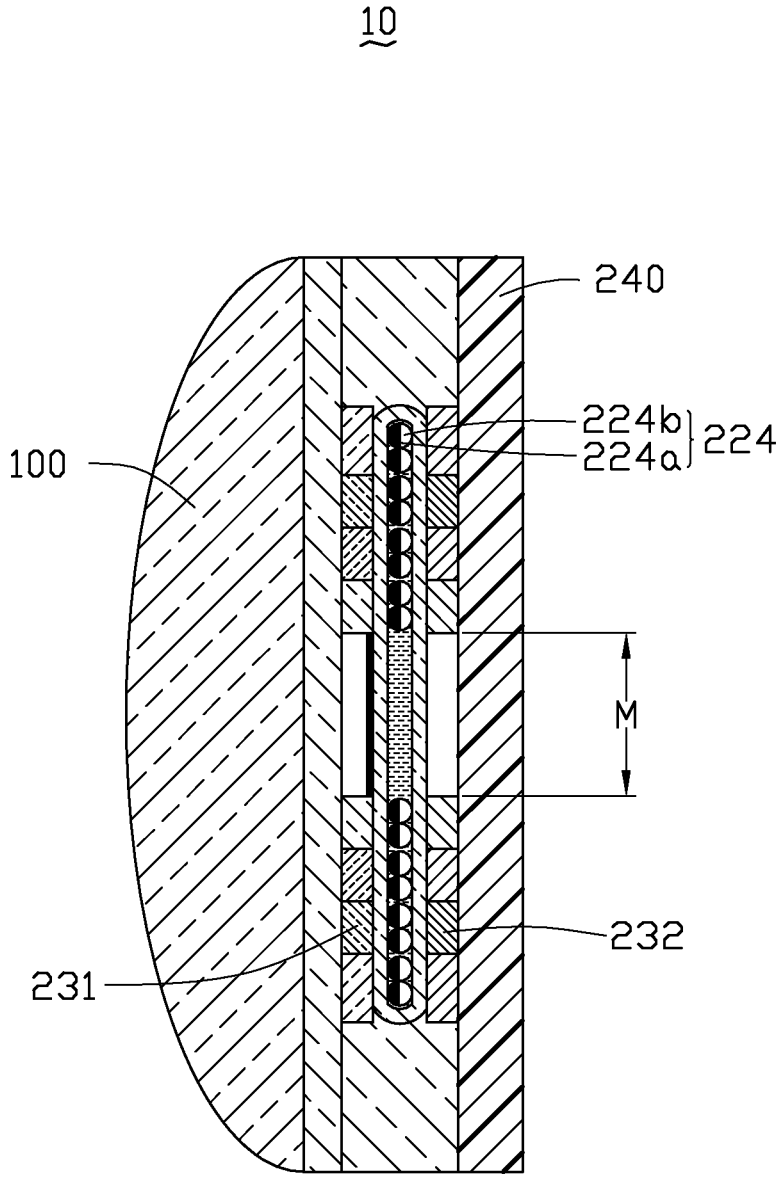
FIG. 4 is a schematic, cross-sectional view of t he eyeball in FIG. 3, taken along the IV-IV line.

Referring to FIGS. 3 and 4, when the first group of annular film electrodes 231 is a cathode and the second group of annular film electrodes 232 is an anode, because the first hemisphere 224*a* of each electrified ball 224 is electropositive and the second hemisphere 224*b* of each electrified ball 224 is electronegative, all the first hemispheres 224*a* of the electrified balls 224 are attracted by the first group of annular film electrodes 231, and will face towards the spherical lens 100. All the second hemispheres 224*b* of the electrified balls 224 are attracted by the second group of annular film electrodes 232, and will face towards the supporting substrate 240. As the supporting substrate 240 is white, the eyeball 10 presents the effect that the black part of the eyeball 10 becomes dilated.

Referring again to FIGS. 1 and 2, when the first, the second, the seventh and the eighth annular film electrodes 231*a*, 231*b*, 231*c*, 231*d* are cathodes, and the third, the fourth, the fifth and the sixth annular film electrodes 231*c*, 231*d*, 231*a*, 231*b* are anodes, since the first hemisphere 224*a* of each electrified ball 224 is electropositive and the second hemisphere 224*b* of each electrified ball 224 is electronegative, all the first hemispheres 224*a* of the electrified balls 224 that are opposite to the third, the fourth, the fifth and the sixth annular film electrodes 231*c*, 231*d*, 232*a*, 232*b* will face towards the supporting substrate 240, and all the second hemispheres 224*b* of the electrified balls 224 will face towards the spherical lens 100, such that the eyeball 10 presents the effect that the black part of the eyeball 10 becomes reduced. It should be understood that when the annular film electrodes are sufficient in number, the annular film electrodes can be controlled by a program controller to achieve a discretionary changing of the eyeball 10.

Figure 5:
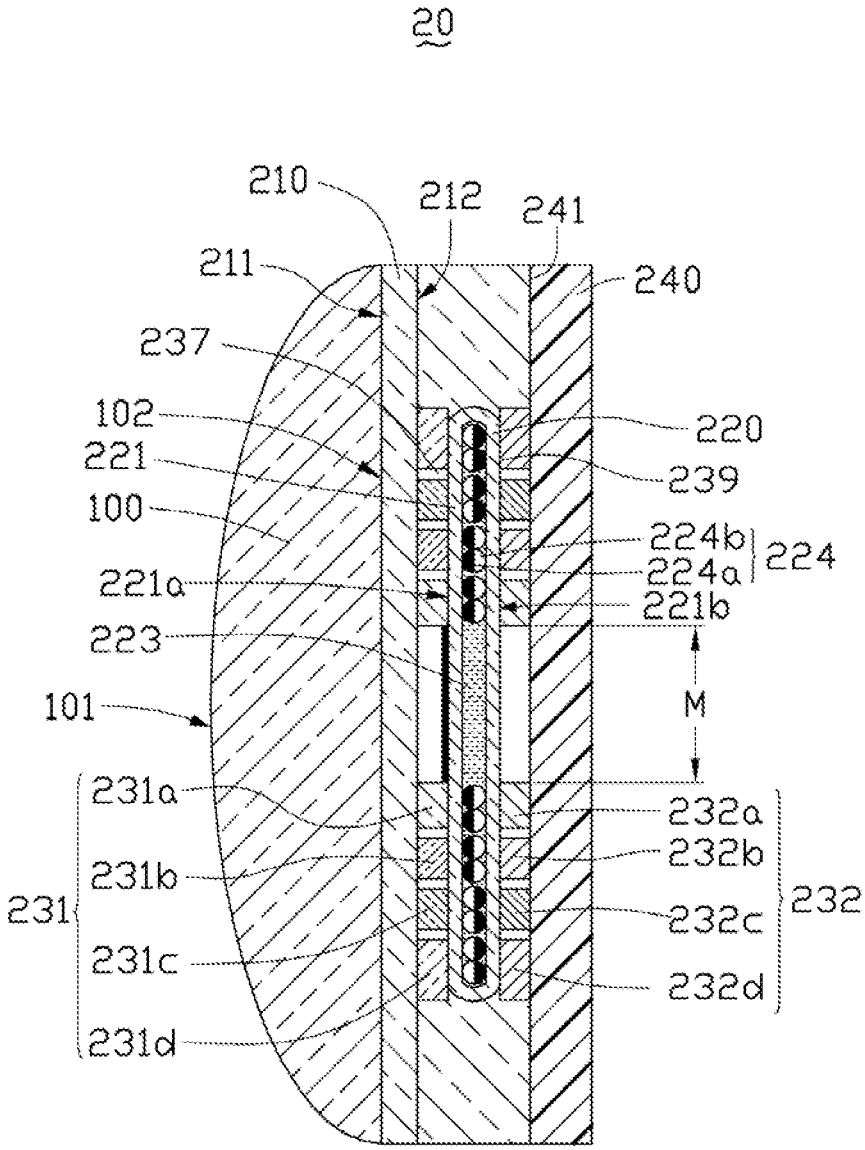
FIG. 5 is a schematic, cross-sectional view of an eyeball of a toy according to a second embodiment.

Referring to FIG. 5, an eyeball 20 of a toy (not shown), in accordance with a second embodiment, is similar with the eyeball 10 of the first embodiment. However, the annular film electrodes 231*a*, 231*b*, 231*c*, 231*d* do not contact each other, and the annular film electrodes 231*a*, 231*b*, 231*c*, 231*d* are dispersedly arranged on the first peripheral surface 221*a*, with a gap 237 being maintained between two adjacent of the annular film electrodes 231*a*, 231*b*, 231*c*, 231*d*. The annular film electrodes 232*a*, 232*b*, 232*c*, 232*d* do not contact each other, and the annular film electrodes 232*a*, 232*b*, 232*c*, 232*d* are dispersedly arranged on the second peripheral surface 221*b*, with a gap 237 being maintained between two adjacent of the annular film electrodes 232*a*, 232*b*, 232*c*, 232*d*. Unlike with the eyeball 10 of th e first embodiment, the first group of annular film electrodes 231 of the eyeball 20 do not need to have the dielectric coating 238 set between each two adjacent of the annular film electrodes 231.

While the present invention has been described as having preferred or exemplary embodiments, the embodiments can be further modified within the spirit and scope of this disclosure. This application is therefore intended to cover any variations, uses, or adaptations of the embodiments using the general principles of the invention as claimed. Further, this application is intended to cover such departures from the present disclosure as come within known or customary practice in the art to which the invention pertains and which fall within the limits of the appended claims or equivalents thereof.

What is claimed is:

1. An eyeball of a toy, comprising:

a transparent chamber comprising a first peripheral surface and a second peripheral surface opposite to the first peripheral surface, the first peripheral surface defining a central region thereof;

a plurality of electrified balls rotatably received in the chamber, each of the electrified balls having a first hemisphere and a second hemisphere, the first hemisphere and the second hemisphere being in different colors, the first hemisphere and the second hemisphere carrying opposite electrical charges;

a first group of annular film electrodes comprising a plurality of annular film electrodes concentrically arranged on the first peripheral surface and facing the electrified balls, each annular film electrode defining a through hole in a center thereof, a dimension of the central region being substantially the same as that of the through hole of the annular film electrode nearest the central region;

a second group of annular film electrodes comprising a plurality of annular film electrodes concentrically arranged on the second peripheral surface and facing the electrified balls; and a coating formed on the peripheral surface in the through hole and being black.

2. The eyeball of a toy of claim 1, wherein the chamber is made of dielectric material.

3. The eyeball of a toy of claim 1, further comprising a transparent dielectric coating formed on each of the first peripheral surface and the second peripheral surface.

4. The eyeball of a toy of claim 1, wherein a gap is maintained between two adjacent of the annular film electrodes.

5. The eyeball of a toy of claim 1, wherein a dielectric coating is sandwiched between two adjacent of the annular film electrodes.

6. The eyeball of a toy of claim 1, wherein the plurality of electrified balls comprises four or more electrified balls, and the first hemispheres of at least two electrified balls adjacent to the central region face a same direction.

7. The eyeball of a toy of claim 1, wherein the first group of annular film electrodes is made of transparent material.

8. The eyeball of a toy of claim 1, wherein the second group of annular film electrodes is made of opaque material.

9. The eyeball of a toy of claim 1, further comprising a spherical lens arranged on the first group of annular film electrodes.

10. The eyeball of a toy of claim 9, further comprising a transparent substrate sandwiched between the spherical lens and the first group of annular film electrodes.

11. The eyeball of a toy of claim 1, further comprising a supporting substrate, the second group of annular film electrodes sandwiched between the supporting substrate and the transparent chamber.

12. The eyeball of a toy of claim 1, wherein the chamber comprises an oily liquid filled therein.

13. The eyeball of a toy of claim 1, wherein the first hemisphere is black and the second hemisphere is white.

14. The eyeball of a toy of claim 1, wherein the annular film electrodes on the first peripheral surface correspond to the annular film electrodes on the second peripheral surface, and the electrode of each of the annular film electrodes on the first peripheral surface is opposite to the electrode of a corresponding one of the annular film electrodes on the second peripheral surface.

15. The eyeball of a toy of claim 14, wherein the electrified balls are concentrically arranged.

16. The eyeball of a toy of claim 14, further comprising a program controller, wherein the program controller is configured for controlling the electrode of each of the annular film electrodes.

17. The eyeball of a toy of claim 16, wherein each of the annular film electrodes of the first group of annular film electrodes is controlled to be a cathode by the program controller, and each of the annular film electrodes of the second group of annular film electrodes is controlled to be an anode by the program controller.

18. The eyeball of a toy of claim 16, wherein the first group of annular film electrodes comprises a first annular film electrode, a second annular film electrode, a third annular film electrode and a fourth annular film electrode arranged in that order from the center to the periphery of the first peripheral surface, the second group of annular film electrodes comprises a fifth annular film electrode, a sixth annular film electrode, a seventh annular film electrode and an eighth annular film electrode arranged in that order from the center to the periphery of the second peripheral surface, the first, the second, the seventh and the eighth annular film electrodes are controlled to each be a cathode by the program controller, and the third, the fourth, the fifth and the sixth annular film electrodes are controlled to each he an anode by the program controller.

* * * * *